United States Patent [19]

Sivon

[11] 4,266,718

[45] May 12, 1981

[54] MODULARIZED RAILWAY CROSSING GRADE AND MODULES THEREFOR

[75] Inventor: Robert L. Sivon, Perry, Ohio

[73] Assignee: True Temper Corporation, Cleveland, Ohio

[21] Appl. No.: 928,540

[22] Filed: Jul. 27, 1978

[51] Int. Cl.[3] ..... E01C 9/04

[52] U.S. Cl. ..... 238/9; 404/44

[58] Field of Search ..... 238/3–9; 404/2, 34, 41, 44

[56] References Cited

U.S. PATENT DOCUMENTS

| | | | |
|---|---|---|---|
| 441,332 | 11/1890 | Schofield | 404/44 |
| 456,378 | 7/1891 | Hurlbut | 404/44 |
| 872,098 | 11/1907 | Westphal | 404/34 |
| 1,707,245 | 4/1929 | Wooldridge | 238/8 |
| 1,721,464 | 7/1929 | Myers | 404/41 |
| 1,729,360 | 9/1929 | Price et al. | 238/8 |
| 1,832,803 | 11/1931 | Alexander | 238/8 |
| 2,242,559 | 5/1941 | Vissering | 404/41 |
| 3,301,147 | 1/1967 | Clayton et al. | 404/41 |
| 3,866,830 | 2/1975 | Hein et al. | 238/8 |

FOREIGN PATENT DOCUMENTS

| | | | |
|---|---|---|---|
| 801727 | 1/1951 | Fed. Rep. of Germany | 238/8 |

*Primary Examiner*—John J. Love
*Assistant Examiner*—Ross Weaver
*Attorney, Agent, or Firm*—Squire, Sanders & Dempsey

[57] ABSTRACT

A module for cooperative installation with a plurality of similar modules proximate a set of railway tracks, and borne upon support members therefor to yield a modularized railway crossing grade assembly, is comprised of a hollow form having exterior side walls, end walls and a bottom wall, a keyway formed in a first end wall and a key formed in the opposing end wall, the keyway and key being of complementary geometrical configuration whereby successive forms may be positively interlocked, and anchoring members for securing the form to a support member. The module is adapted to receive a quantity of load-bearing fill material within the hollow form.

12 Claims, 6 Drawing Figures

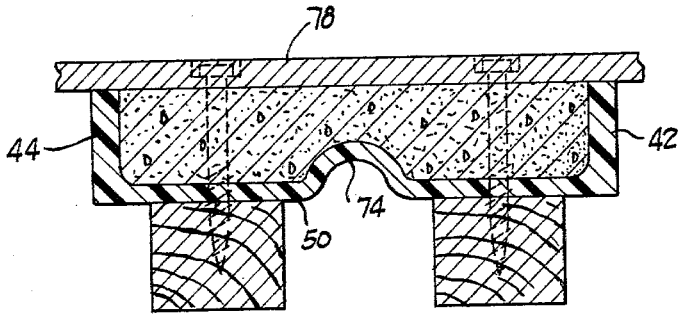
Fig. 4
Fig. 6
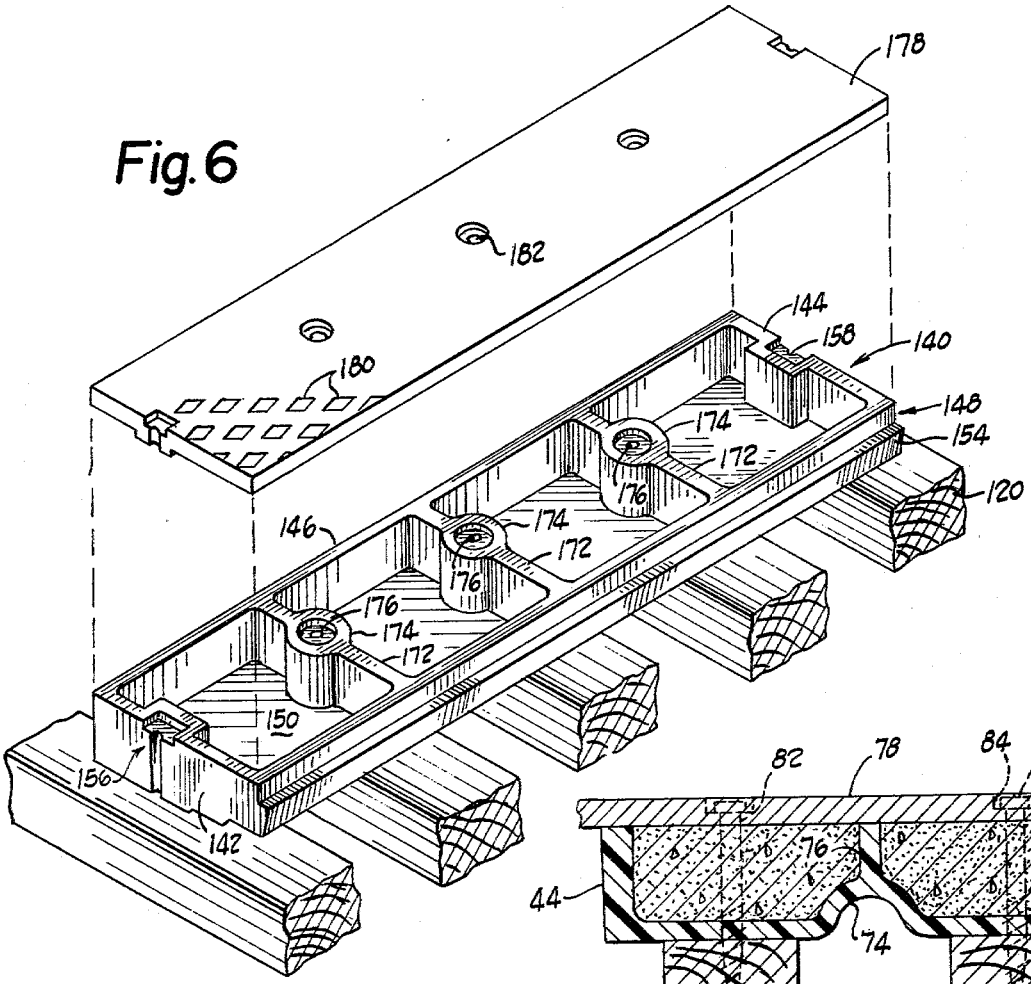
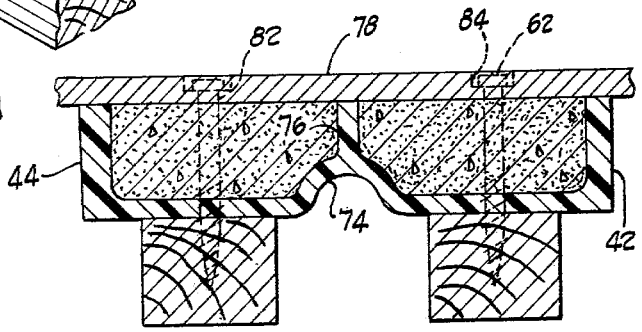
Fig. 5

MODULARIZED RAILWAY CROSSING GRADE AND MODULES THEREFOR

The present invention relates, generally, to modules employed in the construction of railway crossing grades and, more especially, to an assembly of such modules which operate in semi-independent fashion whereby a railroad crossing grade assembly is formed.

Problems attendant the intersection of roadways and railway tracks have long been recognized, the primary problem being the consequence of the disparate modes of conventional rail and vehicular transportation. Some method of raising the roadway grade where the road traverses a set of railway tracks is essential; however, the method or means employed must be tailored to assure railway traffic is not impeded. Approaches heretofor employed have not adequately balanced the diverse considerations between these modes of transportation; but have been predicated on the ability to tolerate tradeoffs in favor of one or the other.

A customary approach to raise the roadway grade, to make the same compatible with the height of the rails constituting the railroad crossing, has been to fill the gauge and field sections of the crossing with road-fill material such as, for example, asphalt or concrete. However, mere filling is not feasible insofar as subsequent degradation of the fill material tends to obstruct the area immediately adjacent the rails, which must be free from such obstructions in order to permit the railroad car wheel flange to cooperate with the track itself.

Retaining structures of general hollow form within which is disposed a road fill material have been employed to alleviate the problem, the form members ostensibly provided to restrain the fill in order to maintain an adequate vehicular path while protecting the wheel flange channel on the gauge side of the track. Certain designs employ a plurality of independent metallic containers which are secured in place by means of plates interposed beneath the bottom of the railway track; while others merely utilize the inherent weight of the filled containers to preclude movement in use. Note U.S. Pat. Nos. 1,707,245 and No. 1,939,425.

Other attempts to employ road fill material for railway crossings make use of a plurality of members secured to the ties disposed parallel to the railroad track sections; between members, road fill material is placed. Along these lines, see, for example, U.S. Pat. Nos. 1,857,458, 2,124,247 and 3,892,356. Compare also U.S. Pat. No. 2,137,566, which is best described as employing pre-cast concrete blocks between the track sections.

More recently, elastomeric, or other polymeric structures have been proposed to raise the road grade across a railway track. See, for example, U.S. Pat. Nos. 3,866,830 and 3,843,051. Note also U.S. Pat. No. 2,839,249 which discloses a railroad track crossing comprised of a number of interlocking plates borne upon appropriate support members therefor.

The aforementioned methods and means of the prior art have encountered difficulties, for example, one or more of the following problems remain unresolved:

(a) modules (where employed) are typically large and cumbersome, necessitating sizeable capital expense in fabrication, transportation, and assembly thereof;

(b) modules (where employed) are either required to operate independently of one another or are, alternately, required to be integrally affixed to the crossing structure by means of plates or the like interposed beneath the bottom of the rail and the support or tie therefor;

(c) modules (where employed) typically require tedious shimming during installation;

(d) modules of the prior art are constructed of metal subject to rusting, etc.

(e) track maintenance is severely hampered by virtue of the designs, whether modular or not;

(f) basic load strength of the elastomeric or polymeric structures is either inherently minimized, as compared with road-fill material, or requires elaborate design criteria to meet the structural demands thereon;

(g) road-fill material (where employed) remains exposed to the environment whereby, under the influence of vehicular traffic and weather, the same rather rapidly degrades requiring extensive maintenance;

(h) installation procedures are burdensome and complicated;

(i) the finished crossing presents a less than desirable surface for vehicular traffic, particularly in terms of a lack of adequate traction; and (j) the components comprising the crossing structure have a pronounced tendency to become loose or disassembled over prolonged periods of use.

In accordance with the foregoing deficiencies of prior art methods and devices, it is a primary object of the present invention to provide a module adapted for cooperation with a plurality of similar modules for assembly of a railway crossing grade of improved integrity in use.

It is also an object of the present invention to provide a railway crossing grade which adequately balances the need to permit both vehicular and railway traffic thereacross without impeding one or the other.

Yet another object of the present invention is to provide a modular railway crossing wherein the modules are relatively small in size, whereby the same may be fabricated and transported to the crossing site more efficiently and less expensively than prior art assemblies.

Still a further object of the present invention is to provide modules for railroad crossing grades, which modules cooperate with similar keyed modules and independently with adjacent sets of keyed modules whereby shimming on installation is minimized.

It is yet another object of the present invention to provide a molularized railroad crossing grade assembly which permits easy and efficient track maintenance of the rail sections thereof.

It is still a further object of the present invention to provide a modularized railroad crossing grade wherein basic load strength therefor is derived from the road fill material.

Yet another object of the present invention is to provide a modularized railroad crossing grade wherein road fill material employed for load strength is protected from weathering and direct contact with vehicular traffic which also insures suitable frictional engagement for the wheels of vehicles passing thereacross.

It has now been determined, in accordance with the present invention, that the foregoing objects may be realized by providing a railway crossing grade assembly comprised of a plurality of associated modules adapted to receive road fill material. The modules are designed for cooperative installation to yield an assembly proximate the railway tracks, which modules are borne upon support members for the rails. Each module is comprised of a hollow form having exterior side and end walls and a bottom wall, with keyway means formed in one of the end walls and key means formed in the opposing end wall, wherein the key and keyway means are of complementary geometrical configuration such that successive modules may be positively interlocked.

In a particularly preferred embodiment, the hollow form further includes interior wall means having a vertical axis in a plane substantially coplanar with the aforementioned first and second end walls, whereby the hollow form is divided into a member of interior compartments adapted to receive the load bearing fill material. This interior wall means might be simply a parallel interior wall, or an arch or rib protruding upwardly from the bottom wall, wherein the arch might also comprise a portion of the bottom wall. Such interior wall means may have a height equal to or less than the height of the exterior walls of the hollow form. Preferably, the hollow form is fabricated from a structural foamed polymer or precast concerete, and includes appropriate means for anchoring the module on a support member. In order to protect the road fill material contained within the hollow form, and provide a good roadway surface, a non-skid top plate may, if desired, cooperate with the modules.

Other objects and advantages of the present invention will become apparent upon examination of a detailed description of the invention, taken in conjunction with the figure of drawings, wherein:

FIG. 4 is a side elevational view of a single module of the present invention, shown resting upon a pair of cross ties;

FIG. 5 is a side elevation view similar to FIG. 4, showing an alternate structure for the module of the present invention; and FIG. 6 is an isometric view of an alternate embodiment of a module of the present invention.

Figure 1:
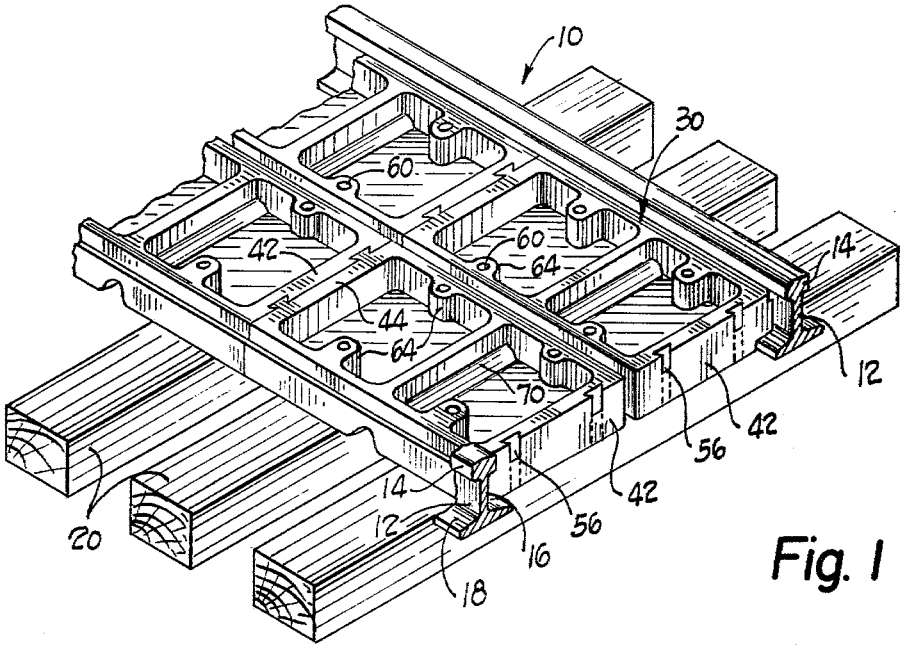
FIG. 1 is an isometric view showing a portion of a railroad crossing having a modularized grade in accordance with the present invention.

Referring now to the figures, in all of which like parts are designated by like reference characters, FIG. 1 shows a railroad grade crossing incorporating the modularized assembly of the present invention; the assembly being shown only within the gauge section, with the front rail broken away for the sake of clarity. The railway crossing, designated generally as 10, is comprised (as is conventional) of a pair of railway tracks 12; each track including a crown 14, a stem 16, and a base 17 comprising laterally projecting flanges 18. The rails 14 are borne upon a plurality of cross ties or sleepers 20. Disposed within the gauge section of the tracks 12 is an assembly comprising the invention, designated generally as 30, which constitutes the crossing grade; the assembly including a number of modules 40. Similar modules may be employed in the field sections to complete the assembly 30.

Each module 40 is of generally hollow form having upstanding end walls 42 and 44, and upstanding side walls 46 and 48. A bottom wall 50 completes the external structure of each module 40.

Figure 3:
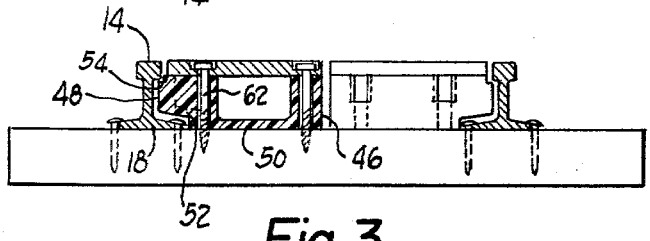
FIG. 3 is an end elevational view of a railroad crossing having a modularized grade assembly in accordance with the present invention.

To facilitate the placement of the individual module 40 suitably close to the rails 12, while yet permitting sufficient clearance between the crown 14 and roadway surface for the flange of the train wheel, the side wall 48 of modules adapted to be so positioned are designed to pre-establish an adequate offset. This offset-defining means comprises a slightly inclined portion 52 of the bottom wall 50 proximate the juncture of side wall 48 therewith, along with an outwardly projecting step 54 on side wall 48 suitably dimensioned to project within the space defined between crown 14 and base flange 18 of the rail 12, best viewed in FIG. 3. The step 54 on a gauge module is also adapted to act as a barrier or shelf to prevent dirt, cinders or like material from collecting about the rail base. A similar step is provided on a field module to achieve the same result, while further providing "worn wheel" clearance on that side of the track.

Each of the end walls 42 has a keyway means 56 formed therein. Preferably, the keyway 56 is a recess or channel extending from the top surface of end wall 42 terminating intermediately the height thereof or might extend entirely across the face of end wall 42 as shown in phantom lines in FIG. 1. Preferably, two such keyways are provided in each of the end walls 42. A key 58, having a geometry complementary with respect to that of keyway 56 which is shown as trapezoidal, is formed in each of the opposing end walls 44. The key 58 is designed to mate within the keyway 56 in order that successive modules 40 may be placed in positive interlocking engagement.

In order to affix the individual modules 40 in position, apertures or through-bores 60 are provided for receiving a fastener 62 therethrough. The fastener 62, preferably a lag bolt, extends through the bore 60 and is secured into the sleeper to tie 20. Depending upon requirements, the number of fasteners 62 employed, and their locations, may vary widely. In a particularly preferred embodiment, such as that shown in FIGS. 1 and 2, the through bores 60 are formed in columns 64 which extend inwardly of the side walls 46 and 48; four such columns being provided for each module and spaced in such a manner that each module is anchored to two adjacent ties.

Under certain circumstances, it is highly preferable to divide the interior of each module 40 into a number of communicating or separate compartments. For example, it is generally desirable to concentrate the bulk of the weight of any road fill material deposited within the module over the supporting tie 20, since the primary load strength of the crossing grade 30 is achieved from this fill material. Accordingly, interior wall means, designated generally as 70, may be provided to extend between opposing side walls 46 and 48 intermediate the end walls 42 and 44. Depending upon design requirements, this interior wall means 70 may be comprised of an arch 74, as shown in FIG. 4, having a projection at the apex less than the height of the end walls 42 and 44. In this manner, the arch 74 (which is a continuous extension of the bottom wall 50) yields two communicating compartments within the module 40. Alternately, the module 40 may be divided into two distinct or separate compartments, by means of an arch of equal height to the end wall or as shown in FIG. 5 by means of a planar wall member 76 formed at the apex of arch 74, and the combined projections thereof corresponding to the height of the end walls 42 and 44.

Generally, it is advisable to employ a cover member 78 for the modules 40. This cover member not only provides protection for any road fill material within the module from the environment, thus shielding the same against degradation and ultimate dislodgement, but can be formed with a non-skid surface promoting traction for vehicular traffic across the railroad grade. As shown in, for example, FIGS. 4 and 5, the cover plate 78 is affixed to the module by means of fastening bolts 62 employed to secure the module itself. Under most circumstances, such fastening of the cover plate 78 is adequate since there will rarely be any need to remove the same independently of the modules. However, optionally, the cover plate 78 might be secured to the modules 40 themselves and, to this end, a plurality of threaded bores 80 may be provided at spaced locations across the top surfaces of the side and end walls of each module. In either event, the corresponding through-bores 82 in top plate 78, which receive the fastening member, are provided with a recess 84 so that the bolt heads of member 62 do not protrude above the surface of the roadway.

An alternate embodiment of the module comprising the grade assembly of the present invention is shown in FIG. 6, and is designated generally as 140. This module is comprised of upstanding end walls 142 and 144, and side walls 146 and 148. A bottom wall 150 completes the exterior structure of the module 140. As in the case of module 40, the side wall 148 is provided with a projecting portion 154 in order to appropriately locate the module adjacent the railway track (now shown) and prevent foreign matter from obstructing the rail base. A keyway 156 is formed in end wall 142; while a key 158 of complementary geometrical configuration is formed in opposing end wall 144.

The module 140 is divided into a plurality of separate compartments by means of transverse interior walls 172, three such walls being shown. Integrally formed therewith are columns 174, each having a recessed through-bore 176. A cover plate 178 is adapted for placement over the module 140 once the module is filled with road fill material. A high-diamond anti-skid pattern 180 is imparted to the top surface of cover plate 178 which is preferably made of elastomeric material. Recessed through-bores 182 are provided in the top cover for registration with bores 176, whereby a fastening member may secure both the module 140 and top cover plate 178 to the tie members 120.

Because the basic load strength of the crossing grade of the present invention is derived from load fill material deposited within the modules, the modules themselves may be fabricated from any of a number of lightweight materials. Thus, the module structure lends itself well to fabrication by casting or molding. Particularly preferred materials from which the module may be manufactured include structural polymers, preferably foamed structural polymers, and concrete. The cover plates employed, are, preferably, made from either a similar structural polymer, elastomeric material, or steel; any of which may easily imparted with an appropriate anti-skid surface. The cover plates might be made of cast concrete, if desired.

Once the individual modules are manufactured, the same may be very easily transported to the installation site. Installation is quite simple, and requires no special tools and very little shimming. The modules are merely placed in position and successive members positively interlocked by virtue of the cooperating key and keyway formed therein. Once positioned in this fashion proximate the tracks, a suitable road fill material may then be deposited within the interior compartment of the modules and allowed to cure. Exemplary of the preferred road fill materials are concrete and asphalt, although other varieties of fill might adequately be employed. Once the road fill material has cured, the cover plate may then be installed, thus completing the modularized crossing.

Depending upon the specific design of module employed, the modules may be secured to the ties by means of the lag bolts, either before or after the road fill material is deposited therein. Because of the design of the columns which receive these fastening members, the through-bores will not be filled with the material deposited in the module compartment. Suitable plugs or fillers may be temporarily installed in the bores to safeguard against introduction of fill material should the ultimate fastening of the module be accomplished after filling the same.

Figure 2:
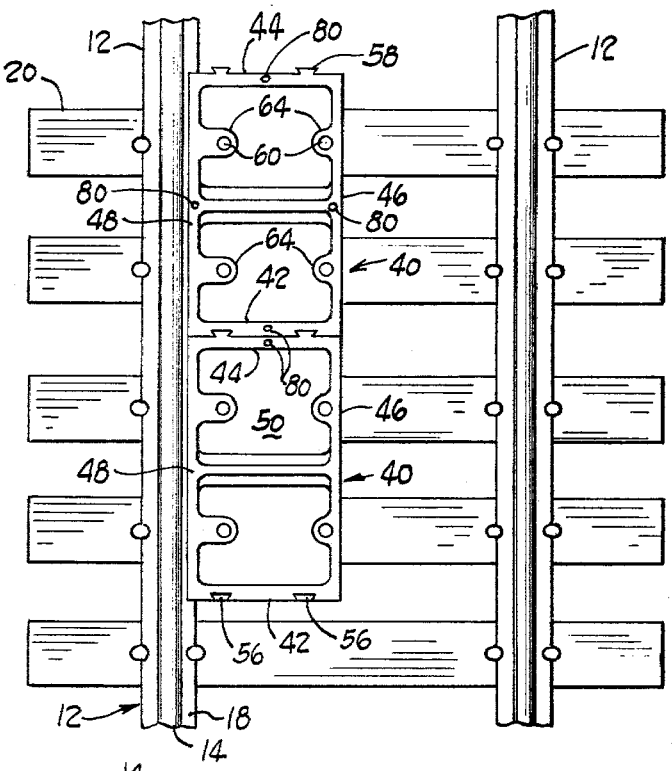
FIG. 2 is a top plan view of a railroad crossing having a partially installed modularized grade assembly in accordance with the present invention.

As shown in FIGS. 1 and 2, two rows of modules 40 are employed within the gauge section of the tracks 12. It is highly preferable that each row operates somewhat independently of the other to prevent buckling of the assembly as a consequence of "tie pumping" or similar occurences. Accordingly, while all of the modules in a given row are aligned with modules in an adjacent row, no interlocking or operative communication between adjacent rows is generally desirable. Consequently, while a cover plate employed may encompass one or more modules in a given row, it is preferred that the cover plate does not extend beyond the width of the individual modules in a single row.

When the assembly 30 is thus completed, a modularized railway crossing grade is established which overcomes the aforementioned disadvantages of conceptually similar grades known in the prior art. The unit, as a whole, possesses substantial structural integrity by virtue of the basic load strenth established by the concrete, or similar, fill. The modules are securely anchored in place, whereby loosening or disassembly of the components is substantially minimized during extended use, while sufficient independence between sets of modules is established due to the present design, whereby the combined action of tie "pumping" and vehicular traffic will not seriously diminish the efficiency of the assembly. Track maintenance is readily facilitated in light of the ability to remove half-sections without disruption of adjacent sections. Because the fill material is substantially completely encapsulated, degradation thereof from weathering is minimized, and the tendency for particules resultant from degradation to lodge within the channel proximate the guage section of the track is materially reduced.

While the present invention has now been described with reference to certain preferred embodiments thereof, the skilled artisan will appreciate that the various substitutions, changes, modifications, and omissions may be made without departing, however, from the spirit of the invention or the scope of the appended claims.

What I claim is:

1. A module for cooperative installation with a plurality of similar modules proximate a set of railway tracks and borne upon support members therefor to yield a modularized railway crossing grade assembly, said module comprising:

(a) a hollow form having exterior side walls, end walls, and a bottom wall;

(b) anchoring means for securing said hollow form to rail supports for a set of railway tracks;

(c) keyway means formed in a first of said end walls;

(d) key means formed in the second, opposing end wall, said key and keyway means being of complementary geometrical configuration whereby successive forms may be positively interlocked; and (e) a cover plate secured to said module.

2. The module of claim 1, further comprising interior wall means extending between said side walls for dividing said form into a plurality of interior compartments.

3. The module of claim 2, wherein said interior wall means comprises an arch protruding upwardly from said bottom wall.

4. The module of claim 3, wherein the apex of said arch has a projection into said form less than the height of said side and end walls.

5. The module of claim 4, wherein said interior wall means further comprises a planar wall member extending upwardly from the apex of said arch.

6. The module of claim 5, wherein the combined height of said planar wall member and said projection is equal to the height of said side and end walls.

7. A railway crossing grade assembly comprising a plurality of the modules of claim 1 disposed proximate a set of railway tracks.

8. The assembly of claim 7, wherein each of said hollow forms contains a road fill material.

9. A railway crossing grade assembly for raising the grade of a roadway where it traverses a set of railway tracks, comprising a plurality of modules positioned on the field and gauge side of said tracks and secured to the supports therefor, each of said modules having a height sufficient to raise said grade to a level substantially the same as the level of said tracks, each of said modules including key means in one end wall and keyway means in the opposing end wall thereof for interlocking successive modules into a plurality of rows, said assembly including cover plates fastened to the top surfaces of each of said modules.

10. The railway crossing grade assembly of claim 9, further comprising road fill material disposed in each of said modules.

11. The assembly of claim 10, wherein said cover plates are non-skid cover plates fastened to the top surfaces of each of said modules.

12. A module for cooperative installation with a plurality of similar modules proximate a set of railway tracks and borne upon support members therefor to yield a modularized railway crossing grade assembly, said module comprising:

(a) a hollow form having exterior side walls, end walls, and a bottom wall;

(b) anchoring means for securing said hollow form to rail supports for a set of railway tracks;

(c) interior wall means extending between said side walls for dividing said form into a plurality of interior compartments, said interior wall means including an arch projecting upwardly from said bottom wall;

(d) keyway means formed in a first of said end walls; and, (e) key means formed in the second, opposing end wall, said key and keyway means being of complementary geometrical configuration whereby successive forms may be positively interlocked.

* * * * *